US008544829B2

(12) United States Patent
Baumhauer et al.

(10) Patent No.: US 8,544,829 B2
(45) Date of Patent: Oct. 1, 2013

(54) ADJUSTMENT SAFEGUARD

(75) Inventors: Joachim Baumhauer, Schwäbisch Gmünd (DE); Alexander Kraus, Göppingen (DE); Yoshiharu Iwasa, Iwate (JP); Daisuke Suzuki, Iwate (JP)

(73) Assignee: Andreas Stihl AG & Co. KG, Waiblingen (DE)

( * ) Notice: Subject to any disclaimer, the term of this patent is extended or adjusted under 35 U.S.C. 154(b) by 370 days.

(21) Appl. No.: 13/074,038

(22) Filed: Mar. 29, 2011

(65) Prior Publication Data

US 2012/0146250 A1 Jun. 14, 2012

(30) Foreign Application Priority Data

Dec. 8, 2010 (JP) ..... 2010-274079

(51) Int. Cl.
*F02M 3/08* (2006.01)

(52) U.S. Cl.
USPC ..... 261/71; 137/382; 137/382.5; 251/92; 261/DIG. 38; 261/DIG. 84

(58) Field of Classification Search
USPC ..... 261/71, DIG. 38, DIG. 84; 137/382, 137/382.5, 385; 251/90, 92, 93, 226, 227; 411/301, 412, 542
See application file for complete search history.

(56) References Cited

U.S. PATENT DOCUMENTS

| | | | | |
|---|---|---|---|---|
| 2,590,217 | A * | 3/1952 | Snyder et al. | 55/417 |
| 3,618,906 | A * | 11/1971 | Charron | 261/41.5 |
| 3,833,171 | A * | 9/1974 | Gifford | 236/102 |
| 4,378,321 | A * | 3/1983 | Miller | 261/41.5 |
| 4,853,160 | A * | 8/1989 | Wood | 261/41.5 |
| 5,252,261 | A | 10/1993 | Gerhardy | |
| 5,630,965 | A * | 5/1997 | Shaw et al. | 261/71 |
| 5,753,148 | A * | 5/1998 | King et al. | 261/71 |
| 5,984,281 | A * | 11/1999 | Hacker et al. | 261/71 |
| 6,302,384 | B1 * | 10/2001 | Douyama | 261/71 |
| 7,097,165 | B1 * | 8/2006 | Braun | 261/71 |
| 8,286,614 | B2 * | 10/2012 | Zbytowski | 123/517 |
| 2004/0017014 | A1 * | 1/2004 | Tobinai | 261/64.2 |

FOREIGN PATENT DOCUMENTS

| | | | | |
|---|---|---|---|---|
| JP | 53-88422 A * | 8/1978 | | 261/71 |

* cited by examiner

*Primary Examiner* — Richard L Chiesa
(74) *Attorney, Agent, or Firm* — Gudrun E. Huckett

(57) ABSTRACT

An adjustment safeguard for a set screw that is rotatably held in a housing has a cap that is non-rotatably secured on the head of the set screw. The cap is received in a sleeve of the housing and surrounded with minimal radial play by the sleeve that is essentially coaxially positioned relative to the cap. The cap is received with its axial length in the sleeve. The cap has a projection and the sleeve has a stop arranged in the interior of the sleeve. Projection and stop interact with each other in a rotational direction of the set screw. The cap has a top part and a separate bottom part. The bottom part is secured axially and non-rotatably on the head of the set screw. The bottom part engages with form fit the top part in the rotational direction and is axially connected to the top part.

20 Claims, 5 Drawing Sheets

ADJUSTMENT SAFEGUARD

BACKGROUND OF THE INVENTION

The invention relates to an adjustment safeguard for a set screw that is rotatably supported in a housing, in particular for a set screw of a carburetor such as a diaphragm carburetor or the like of a hand-guided power tool such as a motor chainsaw or the like. The adjustment safeguard comprises a cap that is non-rotatably secured on the head of the set screw, wherein the cap is surrounded with minimal radial play by an approximately coaxially positioned sleeve, fast with the carburetor housing, and is received in the sleeve across its axial length. The cap has a projection that has correlated therewith a stop disposed in the rotational direction of the set screw inside the sleeve and fast with the carburetor housing.

U.S. Pat. No. 5,252,261 discloses an adjustment safeguard for the adjusting needle (set screw) of a carburetor that is comprised of a cap fixedly secured on the head of the set screw and surrounded with minimal radial play by a coaxially positioned sleeve fast with the carburetor housing. The cap has in rotational direction of the set screw a stop that is fast with the carburetor housing so that after positioning of the cap the user can adjust the set screw only by a limited rotational angle.

The cap is pushed onto a knurled section of the set screw and is fixedly (non-rotatably) connected to the set screw, i.e., does not rotate relative to the set screw. Axially, the cap is secured only by friction so that it can be easily removed by the user by a lever action and the rotational limitation of the set screw can thus be canceled easily.

When the set screw has been properly adjusted before mounting of the cap during servicing or before delivery, it must be ensured that the cap is pushed on in correct position so that the adjustment safeguard is effective. However, the cap—accidentally or wantonly—can be positioned incorrectly so that an effective limitation of the maximally supplied fuel quantity under full load is not ensured.

SUMMARY OF THE INVENTION

It is an object of the present invention to further develop an adjustment safeguard of the aforementioned kind in such a way that mounting in a precise position is ensured and manipulation is prevented as much as possible.

In accordance with the present invention, this is achieved in that the cap is comprised of a top part and a bottom part that is separate from the top part, wherein the bottom part is secured axially and non-rotatably on the head of the set screw and the bottom part engages with form fit the top part in rotational direction and is axially connected to the top part.

The cap of the adjustment safeguard is comprised of a top part and a separate bottom part and is mounted such that the bottom part is axially and non-rotatably secured on the head of the set screw, i.e., cannot rotate relative to the set screw. The bottom part engages with form fit the top part and is axially connected thereto. This configuration of the cap of the adjustment safeguard provides the possibility to configure the bottom part exclusively for safe fixation on the set screw while protection against manipulation and precise positioning during mounting are ensured by the top part.

In a simple way, for a precise positioning during mounting, the stop fast with the housing is correlated with a mounting guide provided on the top part of the cap wherein the mounting guide enables axial mounting of the cap in the sleeve and thus on the set screw in only one rotational position.

In a simple embodiment, the stop at the housing is a stop pin that projects radially into the sleeve and interacts with the top part of the cap. The stop fast with the housing can be mounted in a simple way at a suitable location in the sleeve so that a monolithic configuration of the sleeve and the carburetor housing (body) is possible.

As a mounting guide, the stop pin has correlated therewith an L-shaped or T-shaped guide provided on the outer circumference of the top part, wherein an axial longitudinal groove extends approximately across the length of the top part and passes into a circumferential groove of the top part. The grooves are matched with respect to their width approximately to the dimension (diameter, width) of the stop pin engaging the grooves. This configuration has the advantage that mounting of the cap is possible only when the stop pin and the axial longitudinal groove provided in the outer circumference of the top part are congruently positioned with each other. Mounting is thus ensured in one position only so that wrong mounting of the adjustment safeguard cap is safely prevented. Moreover, the position of the circumferential groove is selected such that a rotation of the cap, together with the adjusting needle, is possible when, and only when, the cap has been pushed completely into the sleeve and the bottom part is locked axially captively on the set screw. Only when this is accomplished, the stop pin is properly positioned in the circumferential groove so that only then rotation of the cap over a limited rotation angle is possible. In an expedient way, the longitudinal groove opens at one end of the circumferential groove into the circumferential groove wherein the circumferential groove is positioned below a terminal collar on the external end face of the top part. In this way, it is ensured that the cap is always pushed completely into the sleeve so that its proper function is possible. Expediently, the circumferential groove extends about a circumferential angle of approximately 270 degrees.

The stop pin is a separate component which is press-fit advantageously into a receptacle of the sleeve. In this connection, the stop pin is expediently made of metal.

The bottom part of the cap is made of plastic material while the top part of cap is comprised of metal, in particular light metal, expediently zinc. In order for the top part and the bottom part to form a functional unit, the bottom part is axially captively locked on the top part. The bottom part engages with inner radial locking elements a circumferential groove on the head of the set screw and with outer radial locking elements the locking cutouts of the top part. In this way, the bottom part is locked axially on the set screw as well as axially on the top part.

In an advantageous embodiment of the invention, on the top part a central opening is provided that has positioned opposite thereto a tool support surface provided on the head of the set screw. By screwing in a removal tool into the opening that is embodied as a threaded opening, the free end of the removal tool is supported on the tool support surface on the head of the set screw so that upon further screw-in action of the removal tool a spreading force is applied that removes the top part in axial direction from the bottom part. With simple means, it is thus possible to remove the adjustment safeguard; the removal tool is a special tool that is not easily available to the user.

DESCRIPTION OF THE PREFERRED EMBODIMENTS

Figure 1:
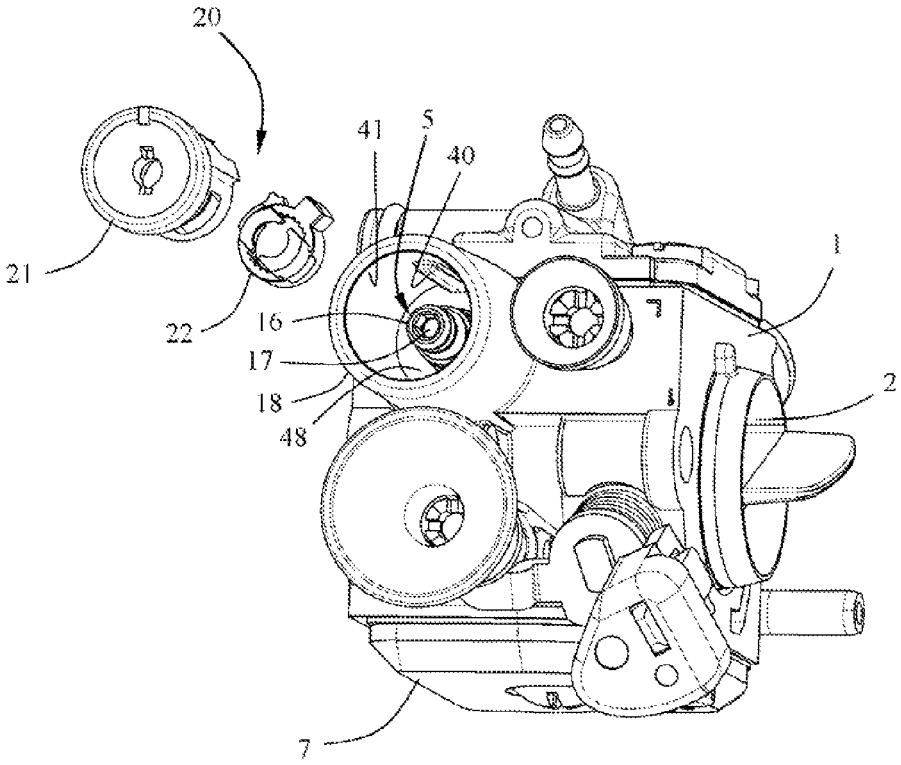
FIG. 1 is an illustration of a carburetor with an adjustment safeguard according to the invention illustrated in an exploded view.
Figure 2:
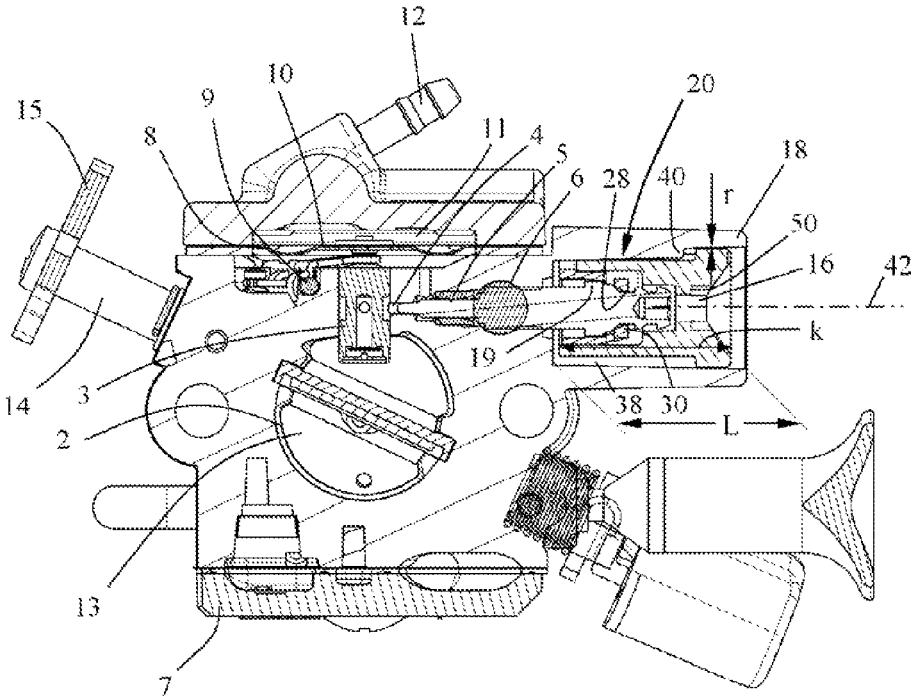
FIG. 2 is a section view of the carburetor according to FIG. 1.

FIG. 1 illustrates a carburetor 1 which is comprised of a carburetor body or housing with an intake passage 2 formed therein. As shown in FIG. 2, a fuel nozzle 3 opens into the intake passage 2 that is supplied with fuel from a fuel passage 4. The tip of an adjusting needle 5 projects into the fuel passage 4; the adjusting needle 5 is used for adjusting the fuel cross-section of the fuel passage 4 and is position-adjustable in the thread 6 by being screwed in or out. The adjusting needle 5 is thus embodied as a set screw.

The illustrated carburetor 1 is a so-called diaphragm carburetor having on one housing side a fuel pump 7 for conveying the fuel and on its other housing side a control chamber 8 with a control valve 9 for providing a uniform pressure in the control chamber 8. The control valve 9 is actuated by a control diaphragm 10 that delimits the control chamber 8. The air pressure existing on the clean side of an air filter is acting on the side 11 of the diaphragm 10 that is facing away from the control chamber 8. For this purpose, a connecting socket 12 is provided.

The under pressure in the intake passage 2 is determined based on the position of the throttle 13 secured on a shaft 14 supported within the carburetor housing. By means of an adjusting lever 15 the throttle shaft 14 is adjusted by an actuating device, not illustrated in detail, in order to adjust the throttle 13 from an idle position (FIG. 2) into a full throttle position.

The maximum fuel quantity that enters at full load the intake passage 2 through the fuel nozzle 3 is determined by the adjusting needle (set screw) 5.

An internal combustion engine that is provided with such a carburetor 1, for example, a two-stroke engine that is installed in a hand-guided power tool such as a motor chain saw, a cut-off machine, a trimmer, a hedge trimmer or a similar portable hand-guided power tool, is adjusted by the manufacturer before being delivered to a permissible maximum fuel quantity in order to ensure that the user will not adjust the engine to a have a fuel/air mixture that is too rich.

For rotation of the set screw 5, its head 16 has a tool engaging area 17, for example, a polygon socket such as a hexagon socket for engagement by a polygon key or hexagon key (Allen key). After the maximum permissible fuel quantity has been adjusted, a rotation of the adjusting needle (set screw) 5 by a user should be allowed only within narrow limits. In order to ensure this, on the head 16 of the set screw 5 an adjustment safeguard in the form of a cap 20 is attached that, with minimal radial play r, is received in a coaxial sleeve 18 so that it is safe from manipulation. The sleeve 18 is a component that is fast with the carburetor 1. Preferably, the sleeve 18 is embodied as a monolithic part of the main body or housing of the carburetor 1. The axial height L of the sleeve 18 is designed such that the cap 20 across its axial length k is received in the sleeve 18. Preferably, the length L of the sleeve 18 is greater than the axial length k of the cap 20 wherein the sleeve 18 surrounds the cap 20 coaxially with tight fit so that manipulation by a user without destruction of the cap 20 is impossible.

The cap 20 is comprised, as shown in FIGS. 1 to 5, of a top part 21 and a bottom part 22. Looking at FIGS. 4 and 5, it is apparent that the bottom part 22 is an internal part and the top part 21 is an external part. The bottom part 22 is pushed or inserted into the top part 21.

The bottom part 22 is comprised of a knurled ring 24 that comprises an inner toothing 26 (for example, a knurling) that has correlated therewith an appropriate toothing 19 (for example, a complementary knurling) on the outer circumference of the adjusting needle 5. For securing the adjusted position of the adjusting needle 5, first the bottom part 22 is pushed across the head 16 onto the toothed section so that the bottom part 22 is fixedly (non-rotatably) secured on the adjusting needle 5. Between the toothing 19 and the head 16 of the adjusting needle 5 a locking groove 28 (FIG. 2) is formed in which diametrically opposed locking elements 30 (FIG. 3) will lock. The locking elements 30 ensure that the bottom part 22 is secured axially on the head 16 of the adjusting needle 5, in particular, is axially captively connected to the head 16 of the adjusting needle 5.

Figure 4:
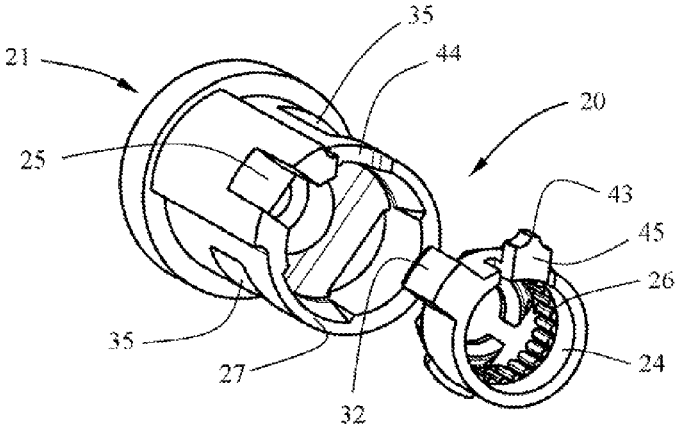
FIG. 4 is a view of the adjustment safeguard according to FIG. 3 looking onto the bottom part.
Figure 5:
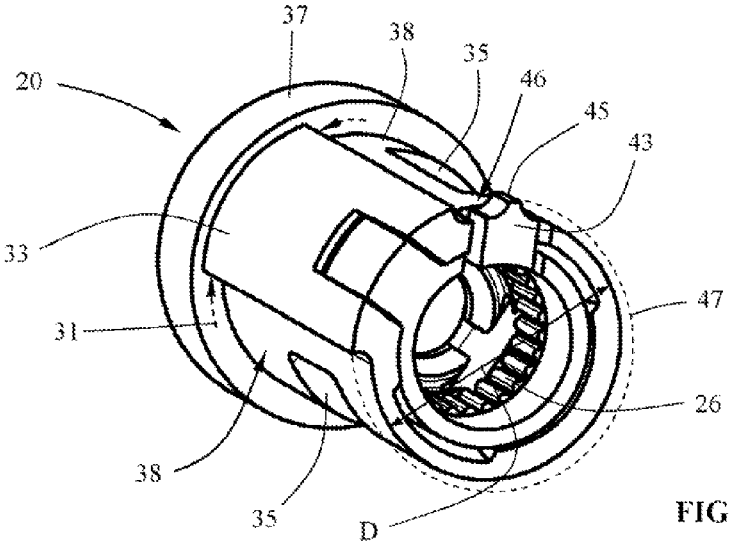
FIG. 5 is a view of the adjustment safeguard according to the invention with joined top part and bottom part.
Figure 6:
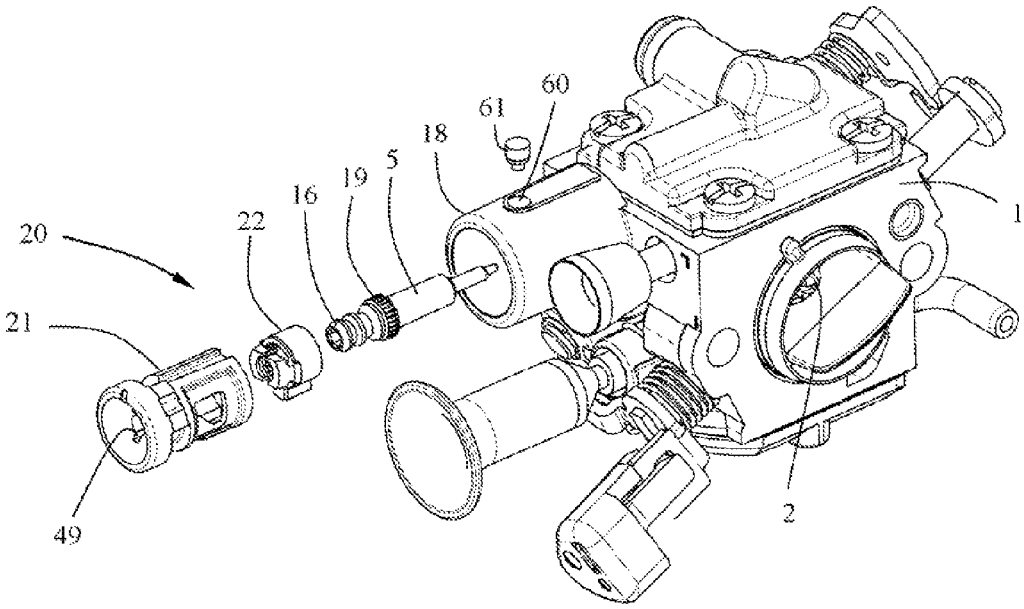
FIG. 6 is a view of a carburetor with a second embodiment of an adjustment safeguard according to the invention.
Figure 7:
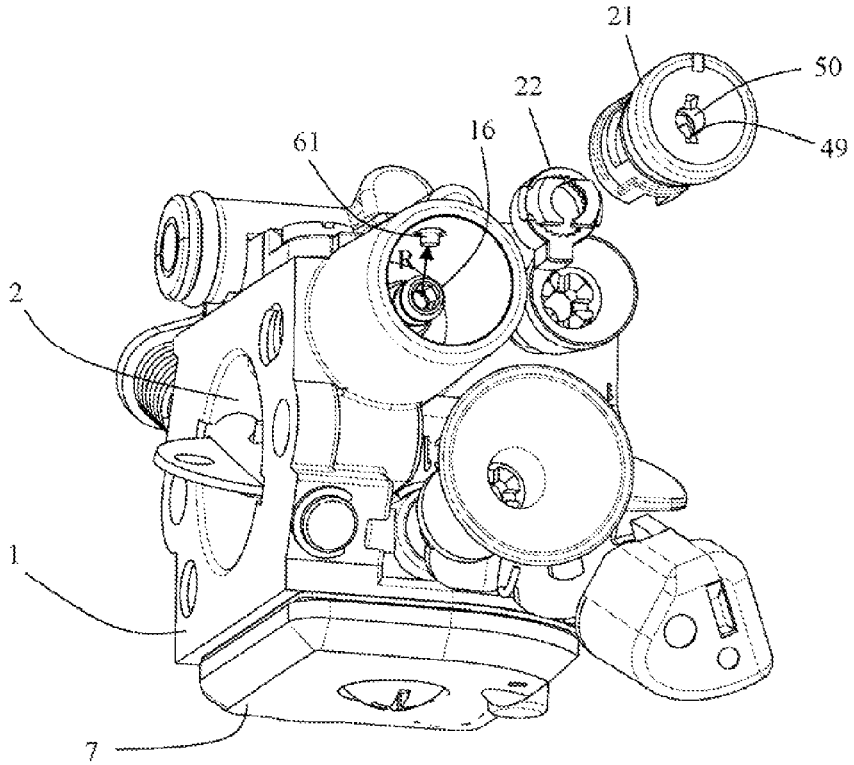
FIG. 7 is a view onto the carburetor according to FIG. 6 with the adjustment safeguard illustrated in an exploded view.

The top part 21 has the shape of a bushing having a bottom 23 that forms an outer end face. The bottom part 22, as shown in FIGS. 4 and 5, is inserted into the top part 21 wherein a rotation pin 32 of the bottom part 22 engages a recess 25 of the top part 21. The recess 25 is formed on the end that is facing the adjusting needle 5 and is open at the end 27 so that the rotation pin 32 can be pushed axially into the recess 25.

In the area of the locking element 30 on the outer circumference of the bottom part 22 locking ribs 34 are formed wherein, relative to the longitudinal axis of the set screw 5, two locking ribs 34 are positioned diametrically opposite each other. The locking ribs 34 engage looking cutouts 35 that are provided in the wall 29 of the top part 21 and effect an axial securing action of the bottom part 22 on the top part 21. In particular, the bottom part 22 is axially captively connected to the top part 21. The locking elements 30 and the locking ribs 34 are expediently provided on a common locking tongue 36 of the bottom part 22.

The top part 21 of the cap 20 has a section that is embodied about a circumferential angle 31 so as to have a smaller outer diameter than the wall section 33. Into the free space 38 that is formed in this way, a stop in the form of a stop rib 40 projects that is provided on the inner circumference 41 of the sleeve 18. The stop rib 40 projects axially parallel to the longitudinal axis 42 of the adjusting needle 5 to a point that is minimally spaced from the terminal collar 37 of the bottom 23 of the top part 21. When the top part 21 is inserted into the sleeve 18, the top part 21 can be adjusted only about the circumferential angle 31 (FIG. 5) of approximately 270 degrees. An adjustment exceeding this angle 31 is prevented by the wall section 33 that hits the stop rib 40 fast with the sleeve 18.

In order to clip the cap 20 of the adjustment safeguard in precise position on the head 16 of the adjusting needle 5, on the collar 37 a marking 39 is provided. Upon insertion of the cap 20 that is comprised of the bottom part 22 and the top part 21, the marking 39 is aligned approximately with the stop rib 40 and the cap 20 is pushed into the sleeve 18. In order to ensure that the wall section 33 is positioned precisely aligned on the stop rib 40, a positional securing element 43 is formed on the bottom part 22. The positional securing element 43, after the bottom part 22 has been inserted into the top part 21, is resting in a cutout 44 at the end of the top part 21. In the inserted state, the positional securing element 43 projects with its radial projection 45 past the diameter D of the free space 38 and delimits with the wall section 33 an insertion groove 46 that forms a type of mounting guide for the positionally precise insertion of the cap 20 into the sleeve 18. It may be advantageous to form the radial projection 45 as a circumferentially extending collar 47 (see dashed line in FIG. 5) that closes off the free space 38 relative to the bottom of the sleeve 18. The stop rib 40 is then designed with an undercut to the bottom 48 wherein the spacing of the stop rib 40 to the bottom 48 is greater than the thickness of the collar 47.

After correct positional mounting of the cap 20, the cap 20, limited by the stop rib 40, can be adjusted only about the adjusting angle 31 (FIG. 5). For this purpose, in the bottom 23 of the top part 21 an engagement slot 49 for an adjusting tool, for example, a screwdriver, is provided.

In case of repair work or in case of servicing, it may be necessary that the adjusting needle 5 must be freely accessible. For this purpose at the center of the bottom 23 an opening 50 is provided into which a removal tool 51 (FIG. 3) can be screwed. The removal tool 51 has a working section 53 positioned at a spacing to the free end 51. The working section 53 is embodied as a threaded section or as a self-tapping section. The threaded section or the self-tapping section is preferably embodied as a left-handed thread. When the working section 53 is embodied as a threaded section, the central opening 50 is embodied as a threaded opening (left-handed thread). When the working section 53 is a self-tapping section, the central opening must not have a thread.

A support action of the removal tool 51 on the head 16 of the adjusting needle 5 is not necessarily required. For removal of the cap 20 a tool is screwed into the central opening 50 and then cap 20 or the top part 21 is pulled out or torn off with destruction of the locking action.

The removal tool 51 is inserted with its leading end 52 through the central opening 50 and projects into the tool engagement opening 17 in the head 16 of the adjusting needle 5. The leading end 52 is smaller than the tool engaging opening 17 so that the leading end 52 can support itself on the bottom of the tool engagement opening 17 without however entraining the adjusting needle 5. When the working section 53 engages the central opening 50, the removal tool 51 is supported on the top part 21 of the cap 20. By screwing the removal tool 51 into the central opening 50, the end 52 is supported on the bottom of the tool engaging opening 17 so that an axial spreading force between the bottom part 22 and the top part 21 is applied. From a certain spreading force on, the locking ribs 34 will break so that the top part 21 is lifted off the bottom part 22. The bottom part 22 can now be removed from the head 16 of the adjusting needle 5 and the adjusting needle 5 is free to be adjusted as needed for the purpose of repair or servicing.

A further embodiment of an adjustment safeguard according to the invention is illustrated in FIGS. 6 through 12. In place of the stop rib 40 on the inner circumference of the sleeve 18, a stop in the form of a stop pin 61 is provided that is secured in a receptacle 60 of the sleeve 18 and projects radially into the interior of the sleeve 18. The basic configuration of the carburetor and of the adjusting device corresponds to that of FIGS. 1 to 5 so that for same parts same reference numerals are employed.

Figure 8:
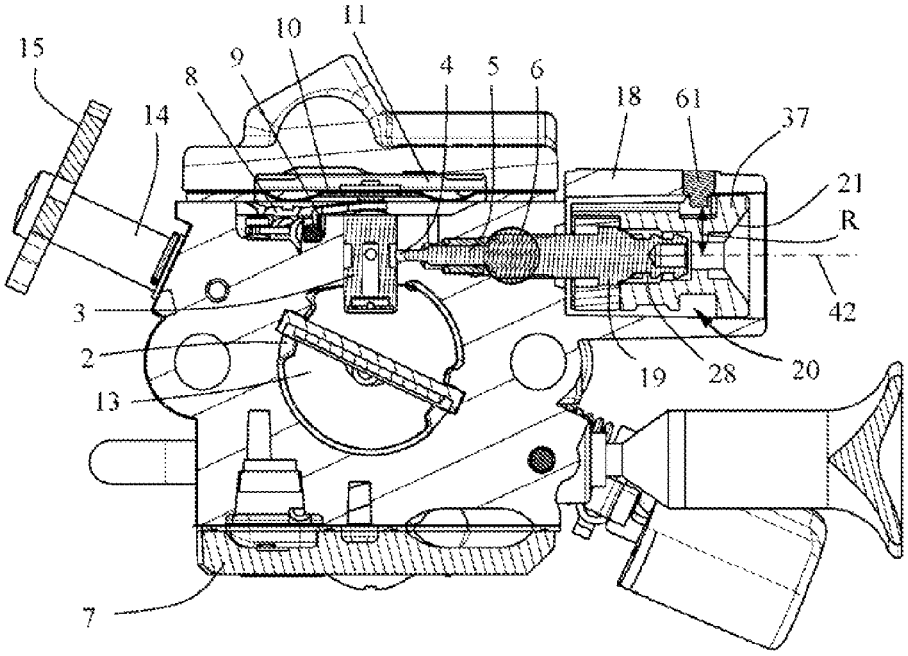
FIG. 8 is a section view of the carburetor according to FIG. 6.

As shown in FIG. 8, the stop pin 61 is positioned near the open end of the sleeve 18 immediately behind the terminal collar 37 of the top part 21 of the inserted cap 20 provided as an adjustment safeguard.

Figure 3:
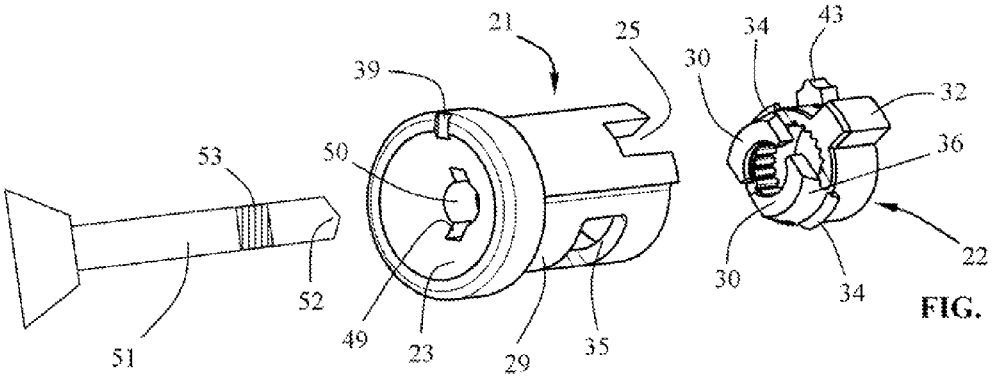
FIG. 3 is view of the adjustment safeguard comprised of top part and bottom part, also showing a removal tool.
Figure 9:
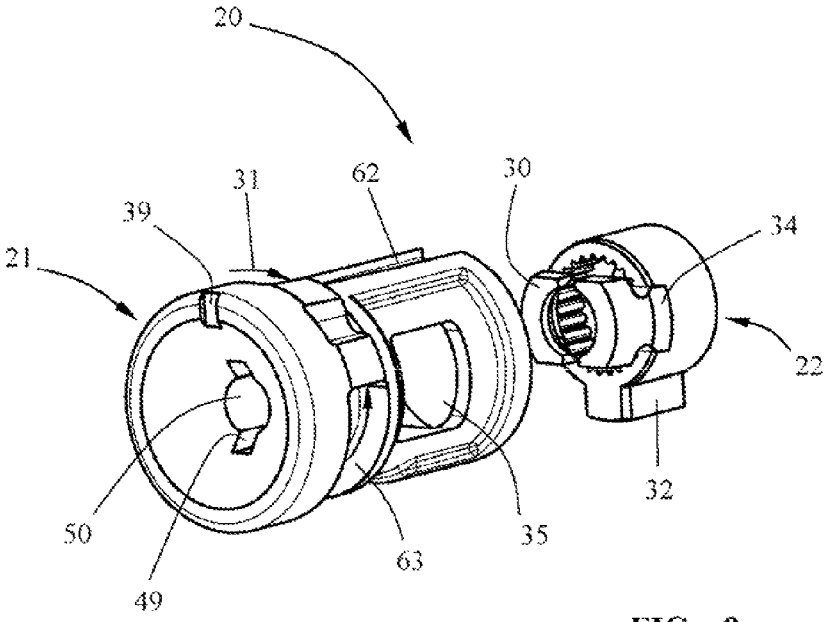
FIG. 9 is a perspective view of the top part and of the bottom part of the second embodiment of the adjustment safeguard.
Figure 10:
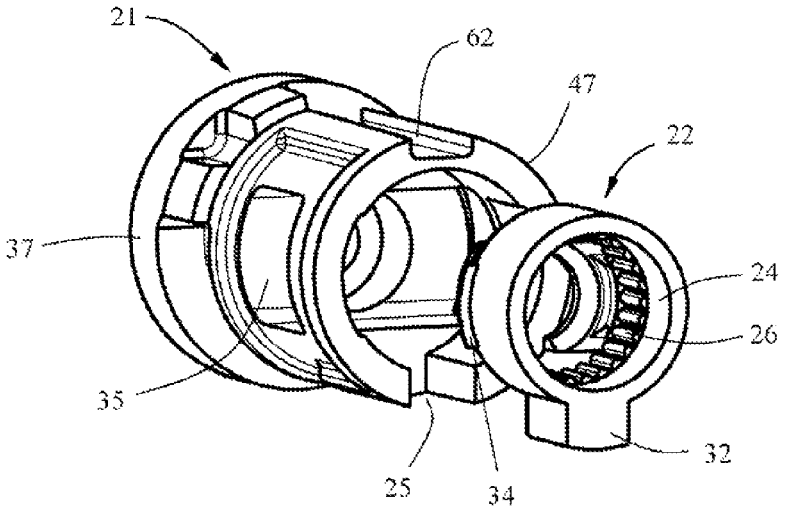
FIG. 10 shows the adjustment safeguard according to FIG. 9 in a view onto the bottom part.
Figure 11:
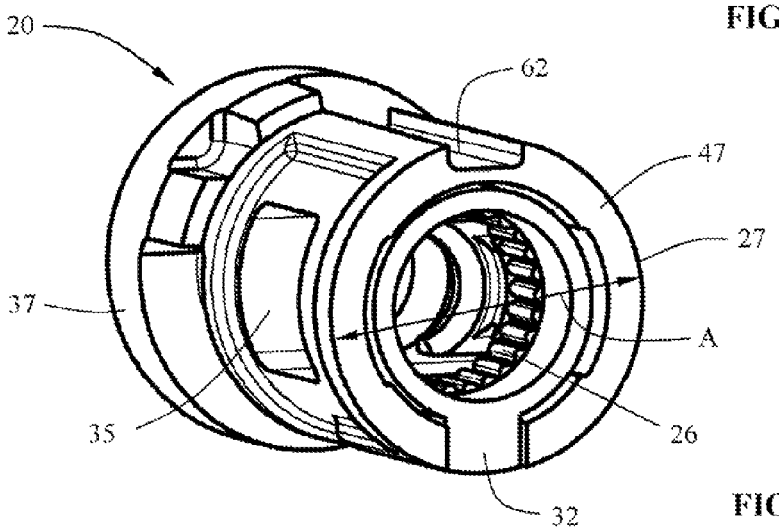
FIG. 11 shows the adjustment safeguard according to FIG. 10 with joined top and bottom parts.

As shown in FIGS. 9 to 11, the bottom part 22, with the exception of the positional securing element 43, is identical to that of FIGS. 3 to 5. The bottom part 22 is inserted into the bushing-shaped top part 21 wherein a radial rotation pin 32 engages an axial recess 25 of the top part 21 so that the bottom part 22 is connected fixedly with the top part 21 for common rotation. As shown in FIG. 11, the top part has at its open free end 27 an outer radius A that is greater than the spacing R (FIG. 8) of the pin from the longitudinal axis 42 of the adjusting needle 5. This corresponds approximately to the embodiment as it is illustrated in dashed lines in FIG. 5.

Figure 12:
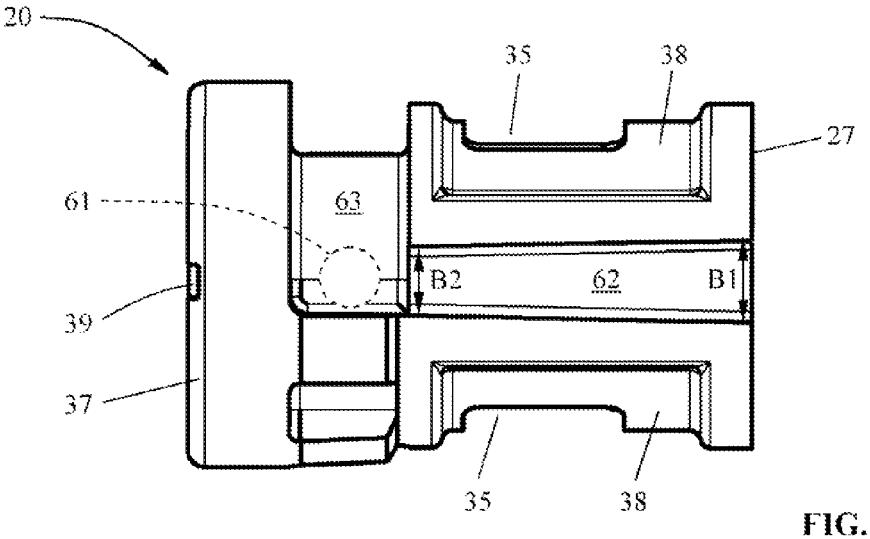
FIG. 12 is a view onto the guide provided in the top part of the adjustment safeguard according to FIG. 11.

In order to be able to insert the cap 20 into the sleeve 18, a mounting guide is provided that comprises a longitudinal groove 62 open at end 27 and, as shown in FIG. 12, extending toward the terminal collar 37 across the length of the top part 21. Preferably, the longitudinal groove 62 in the area of the end 27 of the top part 21 is provided with a greater width B1 than at the end that is facing the terminal collar 37 where it has a smaller width B2. Preferably, the longitudinal groove 62 tapers uniformly from the end 27 of the top part 21 toward the terminal collar 37 of the top parts 21.

Immediately adjacent to the terminal collar 37 on the outer circumference of the top part 21 a circumferential groove 63 is formed that extends about a circumferential angle 31 of approximately 270 degrees. The longitudinal groove 62 opens at an end of the circumferential groove 63 so that an approximately L-shaped guide is provided on the outer circumference of the top part 21.

After the bottom part 22 has been inserted into the top part 21 and has been locked thereat by means of the locking ribs 34 of the bottom part 22 and the looking cutouts 35 of the top part 21, the cap 20 is inserted into the sleeve 18 wherein the rotational position upon insertion of the cap 20 must be aligned such that the stop pin 61 can enter the open end of the longitudinal groove 62 at the end of the top part 21. The greater width B1 serves for easier threading of the stop pin 61 into the sleeve 18. Only at the time when the cap 20 has been axially pressed in fixedly, the stop pin 61 rests in the circumferential groove 63, as indicated in dashed lines in FIG. 12. In this insertion position of the cap 20 the toothing 26 of the knurling of the bottom part 22 has engaged across the toothing 19 of the base member of the adjusting needle 5 and the fixed (anti-rotation) connection with the adjusting needle 5 has been generated. Only when moreover the locking elements 30 of the bottom part 22 have engaged the circumferential groove of the head 16 of the adjusting needle 5 and have locked in place, the stop pin 61 is positioned in the circumferential groove 63 as shown in FIG. 12. Only at this point an engaging tool can be used to move the cap 20 (top part 21 together with bottom part 22) and thus the adjusting needle 5 wherein the rotary angle 31 (FIG. 9) is limited to 270 degrees by the stop pin 61 and the circumferential groove 63.

In order to ensure that for snapping off the top part 21 from the bottom part 22 by means of an applied spreading force the stop pin 61 is aligned with longitudinal groove 62, the working section 53 of the removal tool 51 is embodied as a left-handed thread so that upon screwing in the working section 53 of the removal tool 51 into the central opening 50 the cap 20 is first entrained in rotation until the stop pin 61 hits the end of the circumferential groove 63 and a further rotation is prevented as a result of the pin's position according to FIG. 12. Now the removal tool can be screwed in completely into the central opening and, as already described in connection with the embodiment of FIGS. 1 through 5, a spreading force can be applied between the head 16 of the adjusting needle 5 and the top part 21 of the cap 20 until the locking ribs 34 break or deform to thus release the top part 21 from the bottom part 22.

In a further embodiment of the invention, the top part 21 of the cap 20 is made of metal, in particular light metal, and the bottom part 22 of the cap 20 is made of plastic material. In particular, the top part 21 is made of zinc.

The specification incorporates by reference the entire disclosure of Japanese priority document P2010-274079 filed in Japan on Dec. 8, 2010.

While specific embodiments of the invention have been shown and described in detail to illustrate the inventive principles, it will be understood that the invention may be embodied otherwise without departing from such principles.

What is claimed is:

1. An adjustment safeguard for a set screw that is rotatably held in a housing, the adjustment safeguard comprising:

a cap that is non-rotatably secured on a head of the set screw;

a sleeve fixedly connected to the housing;

wherein the cap is received in the sleeve and surrounded with minimal radial play by the sleeve, wherein the sleeve is essentially coaxially positioned relative to the cap;

wherein the cap has an axial length and the axial length of the cap is essentially received in the sleeve;

wherein the cap has a projection;

wherein the sleeve has a stop arranged in an interior of the sleeve;

wherein the projection and the stop interact with each other in a rotational direction of the set screw;

wherein the cap is comprised of a top part and a bottom part that is separate from the top part;

wherein the bottom part is secured axially and non-rotatably on the head of the set screw;

wherein the bottom part engages with form fit the top part in the rotational direction; and wherein the bottom part is axially connected to the top part.

2. The adjustment safeguard according to claim 1, wherein the top part has a mounting guide interacting with the stop, wherein the mounting guide enables axial mounting of the cap in the sleeve in only one relative rotational position of the sleeve and the cap.

3. The adjustment safeguard according to claim 1, wherein the stop is a stop pin that projects radially into the sleeve and interacts with the top part of the cap.

4. The adjustment safeguard according to claim 3, wherein:

the top part has an L-shaped or T-shaped guide in an outer circumference of the top part;

the L-shaped or T-shaped guide comprises an axial longitudinal groove having a first end and a second end, wherein the first end is open and wherein the axial longitudinal groove extends approximately across a length of the top part;

the L-shaped or T-shaped guide comprises a circumferential groove, wherein the second end opens into the circumferential groove;

the circumferential groove and the axial longitudinal groove have a width that correspond approximately to a width of the stop pin.

5. The adjustment safeguard according to claim 4, wherein the axial longitudinal groove opens into the circumferential groove at a circumferential end of the circumferential groove.

6. The adjustment safeguard according to claim 4, wherein the top part has a terminal collar provided on an outer end face of the top part and wherein the circumferential groove is positioned below the terminal collar.

7. The adjustment safeguard according to claim 4, wherein the circumferential groove extends about a circumferential angle of approximately 270 degrees.

8. The adjustment safeguard according to claim 3, wherein the sleeve has a receptacle and the stop pin is press-fit into the receptacle.

9. The adjustment safeguard according to claim 3, wherein the stop pin is comprised of metal.

10. The adjustment safeguard according to claim 1, wherein the bottom part is made from plastic material and the top part is comprised of metal.

11. The adjustment safeguard according to claim 10, wherein the metal is a light metal.

12. The adjustment safeguard according to claim 1, wherein the bottom part locks axially captively on the top part.

13. The adjustment safeguard according to claim 1, wherein the bottom part has inner radial locking elements and wherein the set screw has a locking groove provided on the head of the set screw, wherein the inner radial locking elements engage the locking groove.

14. The adjustment safeguard according to claim 13, wherein the bottom part has outer radial locking ribs and the top part has locking cutouts, wherein the outer radial locking ribs engage the locking cutouts.

15. The adjustment safeguard according to claim 14, wherein the inner locking elements and the outer locking ribs are formed on a common locking tongue.

16. The adjustment safeguard according to claim 1, wherein the bottom part has outer radial locking ribs and the top part has locking cutouts, wherein the outer radial locking ribs engage the locking cutouts.

17. The adjustment safeguard according to claim 1, wherein the top part has an end facing the bottom part and the end has a recess, wherein the bottom part has a rotation pin that form-fittingly engages the recess.

18. The adjustment safeguard according to claim 1, wherein the top part has a central opening into which an end of a removal tool is screwed and wherein the head of the set screw has a tool support surface, wherein the removal tool is supported with the end on the tool support surface when the removal tool is screwed into the central opening.

19. The adjustment safeguard according to claim 1, wherein the bottom part is formed as an internal part and the top part is formed as an external part.

20. The adjustment safeguard according to claim 1, wherein the housing is a carburetor housing of a diaphragm carburetor of a hand-guided power tool, wherein the set screw is the adjusting needle of the carburetor.

* * * * *